US005376908A

United States Patent [19]

Kawaguchi et al.

[11] Patent Number: 5,376,908

[45] Date of Patent: Dec. 27, 1994

[54] INTERDIGITAL STRIP LINE FILTER HAVING A PLURALITY OF DIFFERENT WIDTH RESONANT ELECTRODES

[75] Inventors: Masahiko Kawaguchi; Katsuji Matsuta, both of Nagaokakyo, Japan

[73] Assignee: Murata Manufacturing Co., Ltd., Nagaokakyo, Japan

[21] Appl. No.: 132,244

[22] Filed: Oct. 6, 1993

[30] Foreign Application Priority Data

Oct. 8, 1992 [JP] Japan ..... 4-269802

[51] Int. Cl.[5] ..... H01P 1/203

[52] U.S. Cl. ..... 333/203; 333/204

[58] Field of Search ..... 333/203, 204, 205, 219, 333/246

[56] References Cited

U.S. PATENT DOCUMENTS

| | | | |
|---|---|---|---|
| 3,451,015 | 6/1969 | Heath | 333/204 X |
| 4,551,696 | 11/1985 | Moutrie et al. | 333/204 |
| 5,105,173 | 4/1992 | Itou | 333/204 |
| 5,248,949 | 9/1993 | Eguchi et al. | 333/204 |

FOREIGN PATENT DOCUMENTS

| | | | |
|---|---|---|---|
| 0164301 | 7/1987 | Japan | 333/204 |
| 0219201 | 9/1988 | Japan | 333/204 |
| 0145803 | 6/1991 | Japan | 333/204 |
| 1261032 | 9/1986 | U.S.S.R. | 333/204 |

*Primary Examiner*—Seungsook Ham

*Attorney, Agent, or Firm*—Burns, Doane, Swecker & Mathis

[57] ABSTRACT

A strip line filter which has a plurality of resonance electrodes on one major surface of a dielectric substrate. A guard electrode is formed on a side of the dielectric substrate and connects the resonance electrodes with a grounding electrode which is formed on the other major surface of the dielectric substrate. Each of the resonance electrodes has a narrow portion in a side near the guard electrode and a wide portion in an open end side. Capacitances generated between the resonance electrodes and the grounding electrode and the inductances of the resonance electrodes form LC resonance circuits. In other words, the resonance electrodes, the dielectric substrate and the grounding electrode form resonators.

1 Claim, 3 Drawing Sheets

INTERDIGITAL STRIP LINE FILTER HAVING A PLURALITY OF DIFFERENT WIDTH RESONANT ELECTRODES

BACKGROUND OF THE INVENTION

1. Field of the Invention

The present invention relates to a strip line filter which is to be installed in a communication circuit or the like.

2. Description of Related Art

FIG. 4 shows a strip line filter of prior art. This filter comprises a dielectric substrate 40 and five resonators which are in serial electrical connection with each other, and functions as a bandpass filter. A grounding electrode 44 is formed entirely on one major surface (back surface) 40*b* of the dielectric substrate 40. On the other major surface (front surface) 40*a* of the dielectric substrate 40, a pair of guard electrodes 46 and 47, a plurality of resonance electrodes 51, 52, 53, 54 and 55 and input/output electrodes 58 and 59 are formed. A capacitance generated between the resonance electrode 51 and the grounding electrode 44 and the inductance of the resonance electrode 51 form an LC resonance circuit. In other words, the resonance electrode 51, the dielectric substrate 40 and the grounding electrode 44 form a resonator. Likewise, the resonance electrodes 52 through 55, the dielectric substrate 40 and the grounding electrode 44 form four resonators.

The guard electrodes 46 and 47 are formed on sides and edges of the dielectric substrate 40 and electrically connected with the grounding electrode 44. The resonance electrodes 51 through 55 are extended from the guard electrodes 46 and 47 alternately, and each of the resonance electrodes 51 through 55 is a strip which has a fixed width. The resonance electrodes 51 through 55 are arranged at a constant pitch, and the electrodes 51 and 55 are connected with the input/output electrodes 58 and 59 respectively.

The intervals S5 among the resonance electrodes 51 through 55 and the length L5 of the resonance electrodes 51 through 55 are determined depending on the center frequency and the bandpass width of the filter. In order to obtain a good bandpass characteristic, the intervals S5 among the resonance electrodes must be sufficiently large, which results in enlargement of the size of the filter. As measures to prevent this, it has been suggested that a material with a small dielectric constant is used for the dielectric substrate 40. By use of such a material, the intervals S5 do not have to be large, whereas the length L5 of the resonance electrodes must be larger such that the capacitances generated between the resonance electrodes 51 through 55 and the grounding electrode 44 will not be smaller. Thus, this does not practically contribute to downsizing of the filter.

SUMMARY OF THE INVENTION

It is an object of the present invention is to provide a small size strip line filter which has a good bandpass characteristic.

In order to attain the object, a strip line filter according to the present invention comprises: a dielectric substrate having two major surfaces; a guard electrode formed on one major surface of the dielectric substrate in a side portion; a plurality of resonance electrodes which are formed on the major surface of the dielectric substrate having the guard electrode thereon and are extended from the guard electrode; and a grounding electrode which is formed on the other major surface of the dielectric substrate, and each of the resonance electrodes has a narrow portion in a side near the guard electrode and a wide portion in an open end side.

Since each resonance electrode has a narrow portion in the side near the guard electrode and a wide portion in the open end side, the Inductance of the resonance electrode is larger than that of a conventional filter. Thereby, a capacitance generated between each resonance electrode and the grounding electrode is larger than that off a conventional filter. Consequently, a filter according to the present invention has resonance electrode's of a smaller length, compared with a conventional filter with the same resonance frequency.

By widening the resonance electrodes in their open end sides, the frequency of odd mode resonance can be lowered and becomes closer to the frequency of even mode resonance. In other words, in the strip line filter according to the present invention, the difference between the frequency of odd mode resonance and the frequency of even mode resonance, which determines the bandpass width, is smaller than that in a conventional filter. Accordingly, the resonance electrodes can be disposed at smaller intervals, compared with those of a conventional filter.

Further, if capacitor electrodes are formed by partly extending the wide portions of the resonance electrodes, the degree of coupling among the resonance electrodes will be enhanced, and the filter will obtain a good bandpass characteristic in a wide range.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

A couple of exemplary strip line filters according to the present invention are described with reference to the accompanying drawings.

Figure 1:
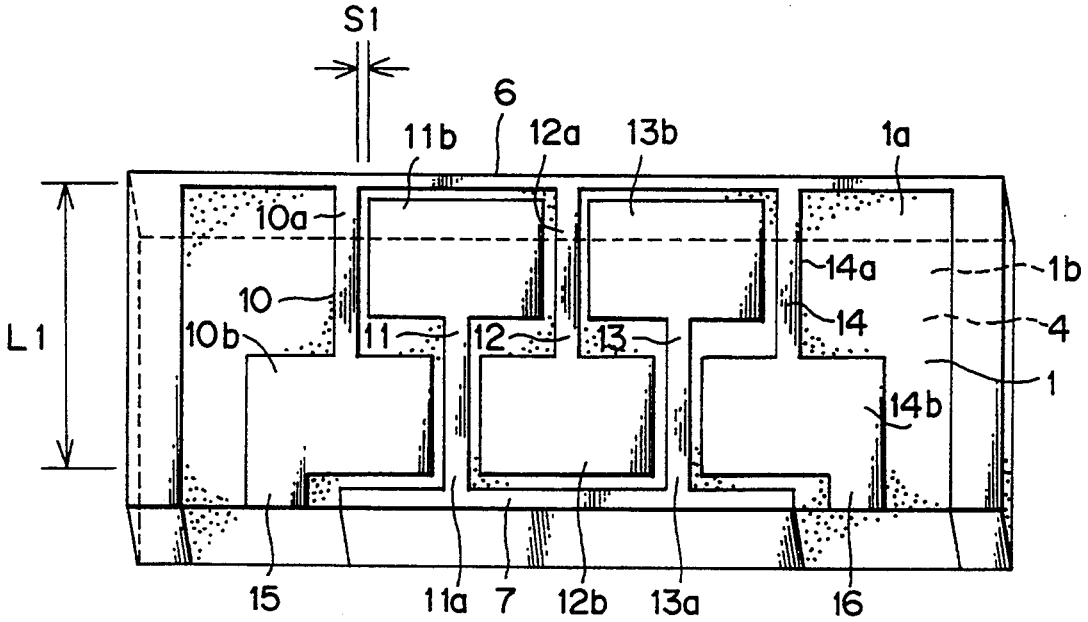
FIG. 1 is a perspective view of a strip line filter which is a first embodiment of the present invention.

First Embodiment: FIG. 1

FIG. 1 shows a micro strip line Filter which has five serially connected resonators on a dielectric substrate 1. This micro strip line filter functions as a bandpass filter. A grounding electrode 4 is formed entirely on one major surface (back surface) 1*b* of the substrate 1. On the other major surface (front surface) 1*a* of the substrate 1, a pair of guard electrodes 6 and 7, resonance electrodes 10, 11, 12, 13 and 14 and input/output electrodes 15 and 16 are formed. These electrodes 4, 6, 7 and 10 through 16 are formed, for example, by printing of silver paste. A capacitance generated between the resonance electrode 10 and the grounding electrode 4 and the inductance of the resonance electrode 10 form an LC resonance circuit. In other words, the resonance electrode 10, the dielectric substrate 1 and the grounding electrode 4 form a resonator. Likewise, the resonance electrodes 11 through 14, the dielectric substrate 1 and the grounding electrode 4 form four resonators.

The guard electrodes 6 and 7 are formed on sides and edges of the dielectric substrate 1 and electrically connected with the grounding electrode 4. The guard electrodes 6 and 7 function to lock electromagnetic fields generated among the resonance electrodes 10 through 14 and to shut off noise from the external world.

The resonance electrodes 10 through 14 are interdigital electrodes which are extended from the guard electrodes 6 and 7 alternately and have narrow portions 10*a* through 14*a* in their root sides and wide portions 10*b* through 14*b* in their open end sides. The resonance electrodes 10 through 14 are disposed at a constant pitch. The narrow portions 10*a* through 14*a* and the wide portions 10*b* through 14*b* are arranged alternately and make a dense pattern. The resonance electrodes 10 and 14 are connected with the input/output electrodes 15 and 16 respectively.

In the structure above, the inductances of the resonance electrodes 10 through 14 are larger than those of a conventional filter. Additionally, the capacitances generated between the resonance electrodes 10 through 14 and the grounding electrode 4 are larger than those of a conventional filter. Accordingly, the resonance frequency of the strip line filter of the first embodiment is lower than that of a conventional filter. Consequently, a filter according to the first embodiment has resonance electrodes of a smaller length L1, compared with a conventional filter with the same resonance frequency.

In the strip line filter, the frequency of odd mode resonance is higher than the frequency of even mode resonance. However, by widening the resonance electrodes 10 through 14 in their open end sides, the frequency of odd mode resonance can be lowered and becomes closer to the frequency of even mode resonance. In other words, in the strip line filter of the first embodiment, the difference between the frequency of odd mode resonance and the frequency of even mode resonance, which determines the bandpass width, is smaller than that in a conventional filter. Thus, a filter which has a good bandpass characteristic (a narrow-band filter) can be obtained. Also, the intervals S1 among the resonance electrodes 10 through 14 can be shortened.

A micro strip line filter according to the first embodiment was compared with a conventional filter which has the same center frequency. The micro strip line filter according to the first embodiment was made as follows: using a plate with a dielectric constant of 70 and a thickness of 1.2 mm for the dielectric substrate 1, and so as to have a center frequency of 1100 MHz. The effective dielectric constant of the micro strip line filter was approximately 44.7.

The conventional filter has a dielectric substrate and resonance electrodes of the following sizes. The resonance electrodes have a width of 1.1 mm and a length of approximately 8.8 mm, and are disposed at intervals of approximately 1.0 mm. The dielectric substrate must be at least 16.5 mm by 9.5 mm.

The filter according to the first embodiment has a dielectric substrate and resonance electrodes of the following sizes. The length L1 of the resonance electrodes is approximately 5.2 mm, and the intervals S1 among the resonance electrodes are 0.2 mm. The dielectric substrate 1 is 15.0 mm by 5.5 mm. Thus, 47% reduction in the area can be achieved.

Figure 2:
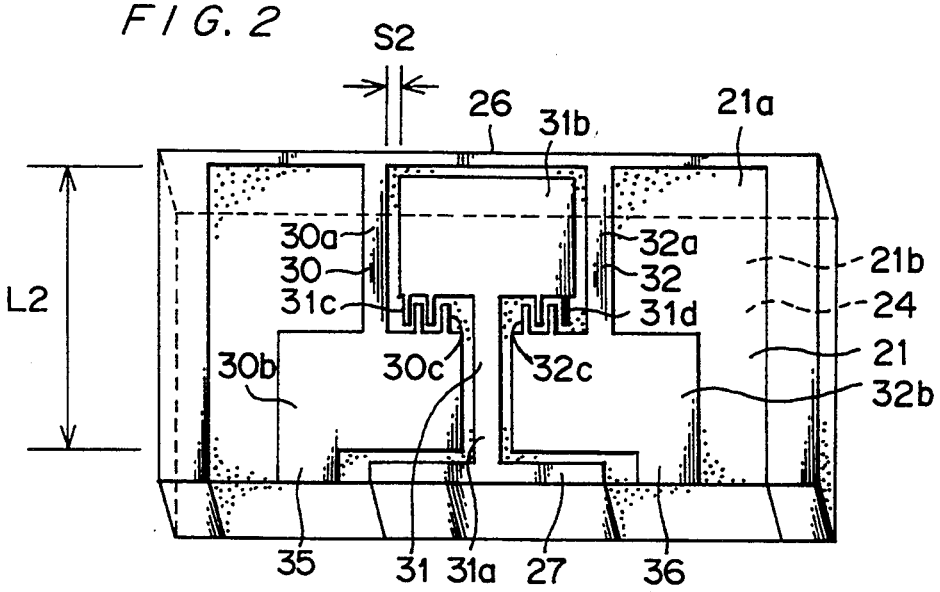
FIG. 2 is a perspective view of a strip line filter which is a second embodiment of the present invention.
Figure 3:
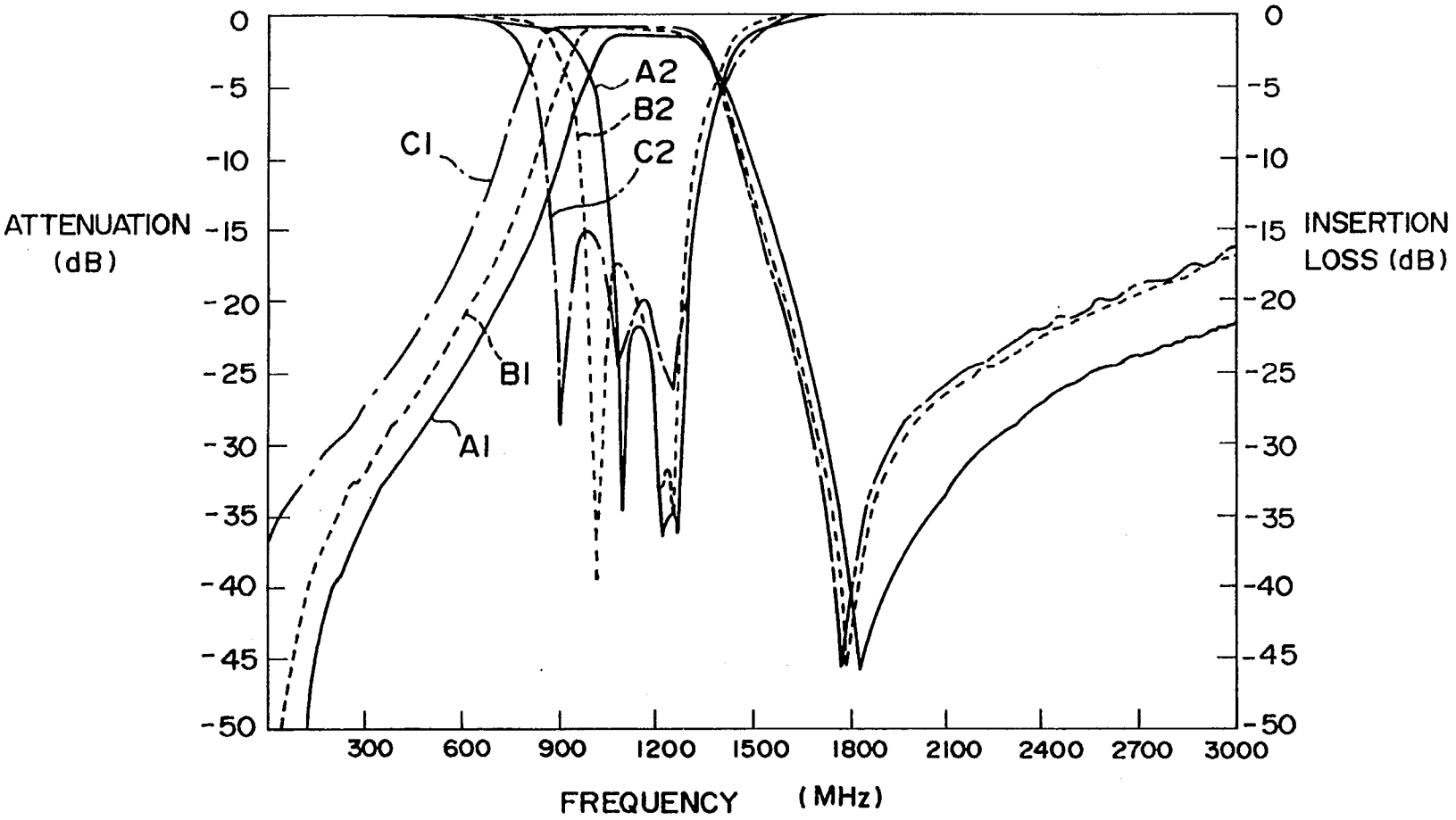
FIG. 3 is a graph showing the bandpass characteristic of the strip line filter shown in FIG. 2.
Figure 4:
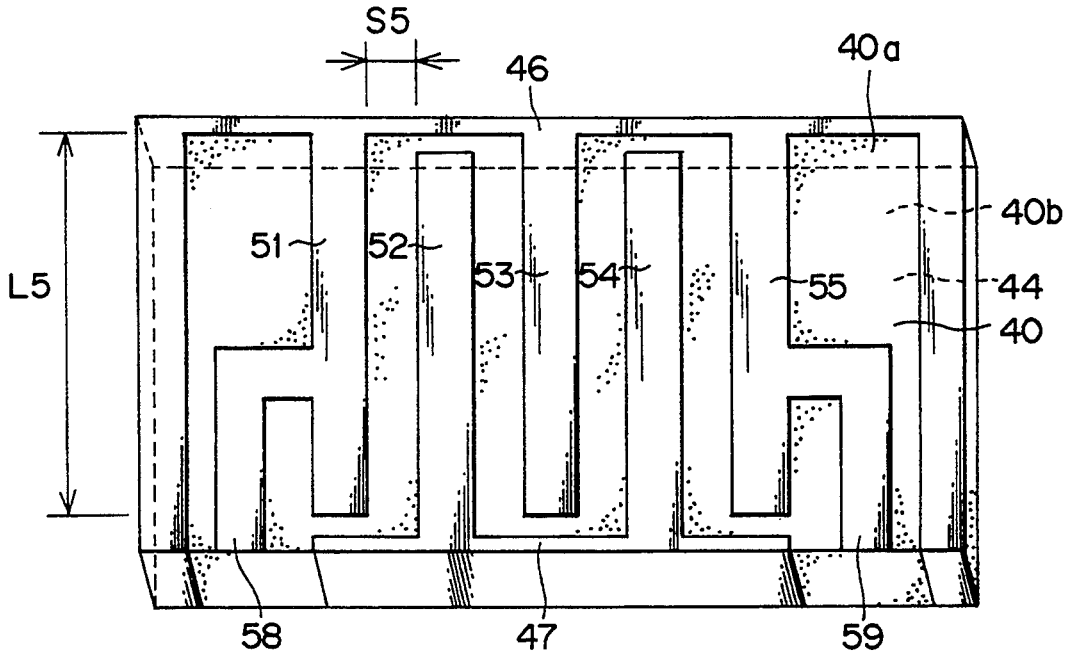
FIG. 4 PRIOR ART
FIG. 4 is a perspective view of a strip line filter of prior art.

Second Embodiment: FIGS. 2 and 3

FIG. 2 shows a strip line filter which comprises a dielectric substrate 21 and three serially connected resonators. This strip line filter functions as a bandpass filter. The strip line filter of the second embodiment is compact and has a good bandpass characteristic in a wide range. A grounding electrode 24 is formed entirely on one major surface (back surface) 21*b* of the dielectric substrate 21. On the other major surface (front surface) 21*a* of the substrate 21, a pair of guard electrodes 26 and 27, resonance electrodes 30, 31 and 32 and input/output electrodes 35 and 36 are formed.

The resonance electrode 30, the dielectric substrate 21 and the grounding electrode 24 form a resonator. Likewise, the resonance electrodes 31 and 32, the dielectric substrate 1 and the grounding electrode 24 form two resonators.

The guard electrodes 26 and 27 are disposed on sides and edges of the dielectric substrate 21 and connected with the grounding electrode 24. The resonance electrodes 30 through 32 are interdigital electrodes which are extended from the guard electrodes 26 and 27 alternately and have narrow portions 30*a* through 32*a* in their root sides and wide portions 30*b* through 32*b* in their open end sides. Further, the wide portions 30*b* through 32*b* have extensions 30*c*, 31*c*, 31*d* and 32*c* which function as capacitor electrodes. The capacitor electrodes 30*c*, 31*c*, 31*d* and 32*c* are interdigital electrodes. The capacitor electrodes 30*c* and 31*c* form a capacitor, and the capacitor electrodes 31*d* and 32*c* form another capacitor.

In the strip line filter, the resonance electrodes 30 through 32 have a larger inductance than those of a conventional filter. Capacitances generated between the resonance electrodes 30 through 32 and the grounding electrode 24 are larger than those in a conventional filter. In the filter of the second embodiment, additionally, capacitances are generated among the capacitor electrodes 30*c* through 32*c*. Thus, the filter has a larger capacitance as a total than a conventional filter, and the degree of coupling among the resonance electrodes is enhanced. Accordingly, the filter obtains a good bandpass characteristic in a wide range.

Also, since the total capacitance of the filter is large, even if a thinner plate is used as the dielectric substrate 21, the filter can maintain a sufficient degree of coupling. Further, the capacitances among the resonance electrodes can be adjusted by changing the pattern of the capacitor electrodes. Thus, the bandpass width can be regulated easily and accurately.

FIG. 3 shows the bandpass characteristics off micro strip line filters. The dielectric substrates 21 of the filters are made of a plate with a dielectric constant of 70 and a thickness of 1.2 mm. The resonance electrodes of the filters have a length of 4.9 mm and are disposed at intervals of 0.2 mm. In FIG. 3, the curves A1 and A2 indicate attenuation and insertion loss of the filter which has no capacitor electrodes. The curves B1 and B2 indicate attenuation and insertion loss of the filter which has capacitor electrodes corresponding to a half of the capacitor electrodes 30*c* through 32*c* shown in FIG. 2. The curves C1 and C2 indicate attenuation and insertion loss of the filter which has the capacitors 30*c* through 32*c* shown in FIG. 2. As is apparent from FIG. 3, the 3dB bandpass widths of the curves A1, B1 and (C1 are 320 MHz, 420 MHz and 540 MHz respectively.

Although the present invention has been described in connection with the preferred embodiments above, it is to be noted that various changes and modifications are possible to those who are skilled in the art. Such changes and modifications are to be understood as being within the scope of the invention.

What is claimed is:

1. An interdigital strip line filter comprising:

a dielectric substrate with a first surface and a second surface;

a first guard electrode and a second guard electrode which are disposed on the first surface of the dielectric substrate at mutually opposite sides and which each include an extended portion which extends to ends of the dielectric substrate;

a plurality of interdigital resonance electrodes disposed on the first surface of the dielectric substrate, each of the interdigital resonance electrodes having an ungrounded end and a ground end, ground ends of adjacent interdigital resonance electrodes being connected with alternate one of the first and the second guard electrodes, the ungrounded end having a wide portion and the ground end having a narrow portion;

a grounding electrode which is disposed on the second surface of the dielectric substrate and is connected with the first guard electrode and the second guard electrode via the extended portions of the guard electrodes on the ends of the dielectric substrate;

a plurality of interdigital capacitor electrodes which are disposed on the first surface of the dielectric substrate and are connected with the wide portions of the resonance electrodes;

an input electrode which is disposed on the first surface of the dielectric substrate and is directly connected with the wide portion of one of the resonance electrodes; and an output electrode which is disposed on the first surface of the dielectric substrate and is directly connected with the wide portion of another of the resonance electrodes;

wherein:

the resonance electrodes, the grounding electrode and the dielectric substrate form resonators.

* * * * *